US009021732B2

(12) United States Patent
Johnson

(10) Patent No.: US 9,021,732 B2
(45) Date of Patent: May 5, 2015

(54) FIREARM TRIGGER RESET ASSIST APPARATUS AND METHOD

(71) Applicant: Julian Eric Johnson, Springboro, OH (US)

(72) Inventor: Julian Eric Johnson, Springboro, OH (US)

( * ) Notice: Subject to any disclaimer, the term of this patent is extended or adjusted under 35 U.S.C. 154(b) by 53 days.

(21) Appl. No.: 13/831,376

(22) Filed: Mar. 14, 2013

(65) Prior Publication Data

US 2014/0259845 A1 Sep. 18, 2014

(51) Int. Cl.
*F41A 19/09* (2006.01)
*F41A 19/10* (2006.01)

(52) U.S. Cl.
CPC ..... *F41A 19/09* (2013.01); *F41A 19/10* (2013.01)

(58) Field of Classification Search
CPC ..... F41A 19/10; F41A 19/30; F41A 19/43; F41A 19/09
USPC ..... 42/69.01–69.03; 89/136
See application file for complete search history.

(56) References Cited

U.S. PATENT DOCUMENTS

| | | | | | |
|---|---|---|---|---|---|
| 1,786,536 | A | * | 12/1930 | Holek | 89/139 |
| 3,197,906 | A | * | 8/1965 | Elkas et al. | 42/69.03 |
| 3,225,657 | A | * | 12/1965 | Kruzell | 89/187.01 |
| 4,028,836 | A | * | 6/1977 | Keppeler | 42/69.03 |
| 4,962,605 | A | * | 10/1990 | Aigner | 42/69.01 |
| 5,074,190 | A | * | 12/1991 | Troncoso | 89/136 |
| 5,736,667 | A | * | 4/1998 | Munostes et al. | 89/132 |
| 5,890,479 | A | | 4/1999 | Morin | |
| 6,550,468 | B1 | | 4/2003 | Tippman, Jr. | |
| 6,634,129 | B1 | * | 10/2003 | Freeman, Jr. | 42/69.02 |
| 6,722,072 | B1 | * | 4/2004 | McCormick | 42/75.03 |
| 6,802,305 | B1 | | 10/2004 | Hatcher | |
| 7,231,911 | B2 | | 6/2007 | Hatcher | |
| 2005/0178373 | A1 | | 8/2005 | Hatcher | |
| 2007/0006507 | A1 | | 1/2007 | Nehrt | |
| 2007/0051236 | A1 | * | 3/2007 | Groves et al. | 89/142 |
| 2010/0269391 | A1 | * | 10/2010 | Doll et al. | 42/70.05 |
| 2012/0096752 | A1 | | 4/2012 | Lee | |

* cited by examiner

*Primary Examiner* — Bret Hayes
(74) *Attorney, Agent, or Firm* — McClure, Qualey & Rodack, LLP

(57) ABSTRACT

An apparatus to assist in trigger reset includes a torsion spring having lower arms mechanically bridged together and upper arms that translate an applied force from a bolt carrier group to a trigger in order to assist in resetting the trigger.

14 Claims, 7 Drawing Sheets

FIREARM TRIGGER RESET ASSIST APPARATUS AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION BY REFERENCE OF MATERIAL SUBMITTED ON A COMPACT DISC

Not Applicable

BACKGROUND

1. Technical Field

The present disclosure relates generally to a trigger mechanism of a firearm and, more specifically, a mechanism for assisting trigger reset upon discharge of a firearm.

2. Description of the Related Art

Pump-action and semi-automatic firearms are well known in the art. Common to all of these types of firearms is their dependency on a user's ability to continually pull the trigger in a rapid manner when a high rate of fire is desired. Because human fatigue reduces an amount of time that a high rate of fire can be sustained, or physiological impairments may interfere with a user's ability to operate the trigger effectively, there are ongoing efforts to improve firearm design.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1A:
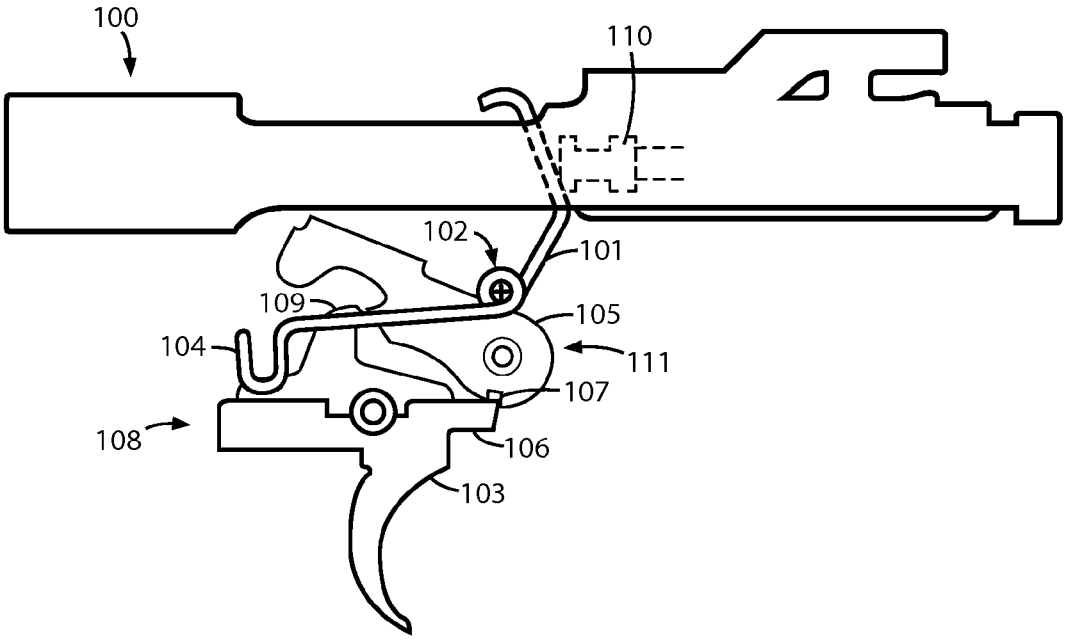
FIG. 1A shows one embodiment of a firearm having a trigger reset assist spring at a beginning of a firing cycle, wherein the firearm is in a closed bolt position prior to trigger activation.

Firearm technology dates back to at least the twelfth century, where a firearm resembled a lance or a spear with gunpowder on an end that could be lit to direct flames at an enemy. Since then, there has been significant innovation in firearm technology. Generally speaking, modern firearms use an expansion of gasses to propel ammunition out of a barrel of a firearm and over a distance. Today, firearms are well-known in the art and are quite sophisticated. Modern firearms have firing capabilities ranging from single shot to fully automatic, are made of a wide variety of materials, and utilize a wide variety of ammunition.

There are two basic types of firearm firing cycles: open bolt and closed bolt. A bolt or bolt carrier group is a part of a firearm that forces the expansion of gasses and moves the ammunition or cartridge into and down a barrel of the firearm and out of a muzzle of a firearm. In an open bolt cycle, the bolt or bolt carrier group typically starts in a rearward position. When a trigger is pulled, the bolt or bolt carrier group moves forward pushing the cartridge into the barrel of the gun. The expansion of gasses then pushes the cartridge out of the firearm. The bolt or bolt carrier group is then returned to the rearward, or open bolt, position and awaits a next pull of the trigger.

In a closed bolt cycle, the bolt or bolt carrier group typically starts in a forward position with ammunition or a cartridge already positioned in the barrel. When the trigger is pulled, the expansion of gasses pushes the bolt carrier group rearward, which propels the cartridge out of the barrel. When the bolt or bolt carrier group reaches its maximum rearward position, it reverses direction and slides forward towards the starting position. As the bolt or bolt carrier group slides forward, it pushes a new cartridge into the barrel. The cycle is completed when the bolt or bolt carrier group reaches its starting forward position, awaiting a next trigger pull.

In addition to different firing cycles, firearms can employ a range of firing mechanisms from single-shot to fully automatic. A pump-action firearm, requires a user to manually move the bolt or bolt carrier group after each pull of the trigger. A semi-automatic firearm is one in which a full firing cycle of the bolt or bolt carrier group is accomplished by each pull of the trigger. Thus, a full cycle of a semi-automatic firearm includes both firing and reloading of the ammunition. To initiate another firing cycle in a semi-automatic firearm, the trigger must reset and the user must pull the trigger again. A fully automatic firearm is one in which the bolt or bolt carrier group will continue to fully cycle until the trigger is released.

Though mostly associated with wartime activities, firearms are used in many peaceable settings, such as for hunting and in shooting competitions. Indeed, peaceable recreational use of firearms is increasing. During shooting competitions it is often desired to shoot rapidly. Insofar as government regulations prohibit recreational use of fully automatic firearms, firing speed is dependent upon how fast a user can repeatedly pull the trigger of the firearm. During a competition, the user may suffer from fatigue, which will decrease the rate at which the user can pull the trigger. This results in a reduction of firing speed and can negatively impact user performance during competitions.

Additionally, many physical conditions, such as rheumatoid arthritis and carpel tunnel syndrome, can impair a user's ability to extend their fingers after contracting them. These finger extensor limitations impair a user's ability to operate a semi-automatic firearm or pump-action firearm. Specifically, a user may be able to contract a finger to pull the trigger, but the inability to extend their finger after pulling the trigger prevents the trigger from properly resetting. The trigger is prevented from resetting because the user's contracted finger physically interferes with the trigger returning or resetting to its starting position. As previously indicated, if the trigger of a semi-automatic firearm or pump-action firearm is not properly reset, the firearm cannot be re-fired. Thus, there exists a need that has not been fully addressed by the current art for improved mechanisms for assisted and faster trigger reset that still keeps the firearm operating as a semi-automatic.

The embodiments disclosed herein seek to provide a trigger reset assist apparatus and method that supplements an existing trigger spring, and functions to decrease or eliminate a force needed to reset the trigger of a firearm. In one embodiment, an upper region of a torsion spring, that is in addition to any existing stock trigger springs, is engaged by the bolt carrier group as it moves rearward during a closed bolt firing cycle, which causes a lower region of the torsion spring to apply a force to the trigger to assist with trigger reset.

With these concepts in mind, reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

With this general description in mind, attention is first directed to FIGS. 1A through 1H, which show one embodiment of a firing cycle of a firearm employing the disclosed trigger reset assist spring. Discussion of the firing cycle begins with FIG. 1A, which shows one embodiment of a firearm having a trigger reset assist spring at a beginning of the firing cycle, wherein the firearm is in a closed bolt position prior to trigger activation. This position is also referred to as a cocked or a ready-to-fire position. This position is considered, for the purposes of defining a cycle, a start of the firing cycle. In this position a bolt carrier group 100 is in a closed bolt position. In other words, the bolt carrier group 100 is in a forward position, such that the bolt carrier group 100 does not make contact or engage an upper arm 101 of a trigger reset assist spring 102. Insofar as there is no force applied to the upper arm 101 of the trigger reset assist spring 102, one having ordinary skill in the art will appreciate that there is, likewise, no corresponding force applied to a trigger 103 by a lower arm (or bridge) 104 of the trigger reset assist spring 102. A trigger 103 is any mechanism that actuates the firing sequence of a firearm.

In the closed bolt position shown in FIG. 1A, a hammer 105 is engaged with a trigger sear 106 at the hammer interlock 107, which is a notch at one end of the hammer 105. The trigger sear 106 is a part of the trigger 103 that holds the hammer 105 by engaging the hammer interlock 107 until a sufficient amount of force is applied to the trigger 103 by a user, at which point the hammer 105 is released to discharge the firearm. One having ordinary skill in the art will appreciate that a typical trigger activation or trigger pull force is from approximately 3 pounds to approximately 6 pounds. However, custom designs have utilized a trigger activation force of as low as approximately 1 pound to as high as approximately 9 pounds. For some embodiments the trigger sear 107 is fully integrated with the trigger 103. In other embodiments the trigger sear 107 is a separate and independent part of a trigger group 108, which comprises all parts of the firearm that initiate firing of ammunition.

When the hammer interlock 107 is engaged with the trigger sear 106, the hammer 105 does not engage a disconnector 109 or a firing pin 110. The disconnector 109 is an important and required safety feature of semi-automatic and pump-action firearms. In short, the disconnector 109 functions to ensure that only a single round of ammunition is fired with each activation of the trigger 103 by engaging various parts of the trigger group 108 during the firing cycle to disconnect the trigger sear 106 until the trigger 103 is reset. Stated differently, the disconnector 109 prevents a semi-automatic firearm from becoming a fully automatic firearm. This stage in the cycle is ended when the user pulls or activates the trigger 103.

Figure 1B:
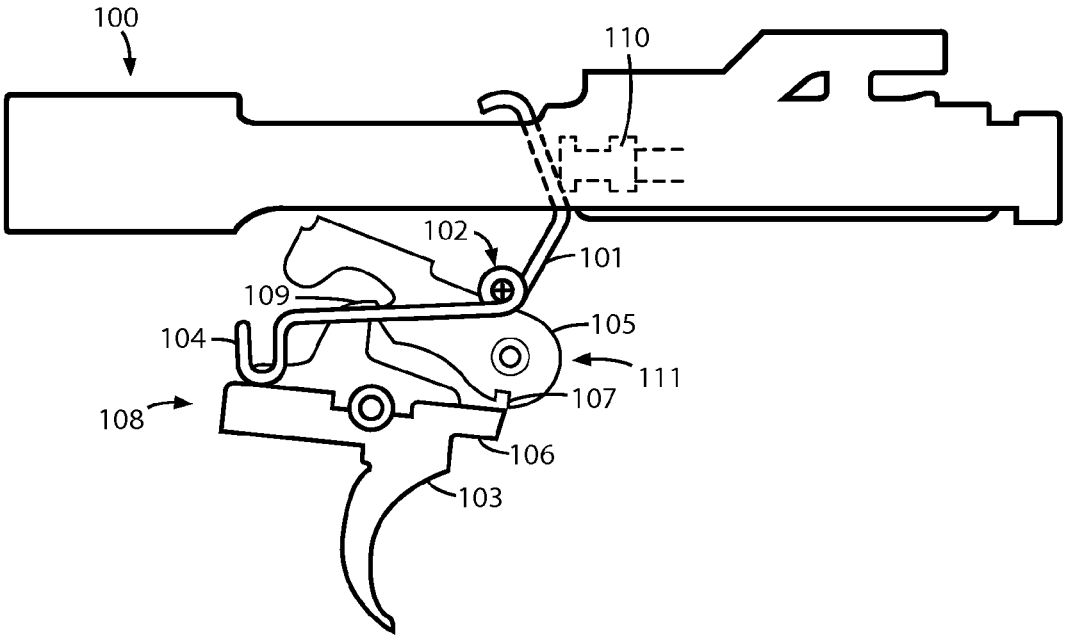
FIG. 1B shows one embodiment of a firearm having a trigger reset assist spring at a point in the firing cycle immediately after trigger activation.

With this in mind, attention is turned to FIG. 1B, which shows one embodiment of a firearm having a trigger reset assist spring 102 at a point in the firing cycle immediately after trigger 103 activation. One having ordinary skill will appreciate that a pulling movement of a user's finger against the trigger 103 typically activates the trigger 103. However, other methods of trigger activation are to be considered within the scope and spirit of this disclosure. At this point in the firing cycle, the trigger sear 106 is released from the hammer interlock 107. This allows the hammer 105 to begin its movement within the firing cycle. At this point, the hammer has not yet engaged the firing pin 110, nor engaged the disconnector 109. The bolt carrier group 100 is not yet beginning its rearward motion and is not applying any force or otherwise coming in contact with the upper arm 101 of the trigger reset assist spring 102.

In contrast, due to motion of the trigger 103 when activated, the lower arm 104 of the trigger reset assist spring 102 comes in contact with the trigger 103. Although the lower arm 104 of the trigger reset assist spring 102 is in contact with the trigger 103, no force is applied to the lower arm 104 of the trigger reset assist spring 102. One having ordinary skill in the art will appreciate that there is no defined endpoint to this stage in the firing cycle. Rather, the firing cycle continues seamlessly as various parts of the trigger group 108 continue their movements initiated by trigger 103 activation.

Figure 1C:
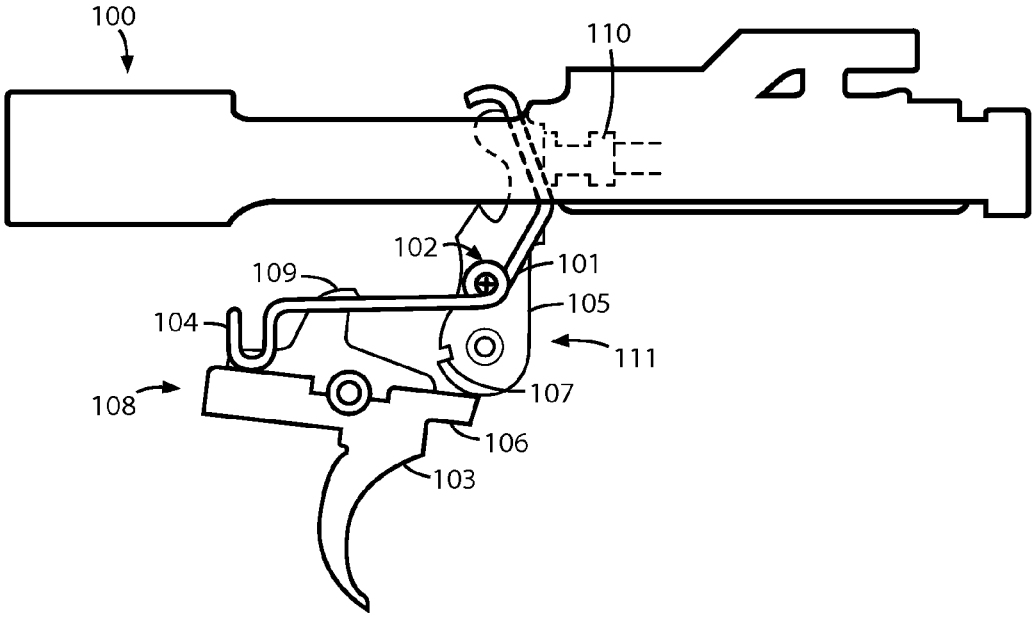
FIG. 1C shows one embodiment of a firearm having a trigger reset assist spring at a point in the firing cycle wherein a hammer engages a firing pin located within a bolt carrier group of the firearm.

Discussion of the firing cycle continues with FIG. 1C, which shows one embodiment of a firearm having a trigger reset assist spring 102 at a point in the firing cycle where the hammer 105 engages the firing pin 110 located within the bolt carrier group 100 of the firearm. At this point in the firing cycle, the hammer 105 is striking the firing pin 110, or other discharge mechanism to discharge the ammunition or cartridge. The trigger 103 is physically prevented from returning to its closed bolt, or starting, position (FIG. 1A) by a contoured end 111 of the hammer 105. Still, at this stage in the firing cycle, the bolt carrier group 100 has yet to begin its rearward motion. As such, no force is applied to the upper arm 101 of the trigger reset assist spring 102 at this point. The lower arm 104 of the trigger reset assist spring is still in contact with the trigger 103, however there is no force being applied to the trigger 103 by the lower arm 104 of the trigger reset assist spring 102. This stage of the firing cycle can be said to end when the cartridge is discharged within the firearm.

Figure 1D:
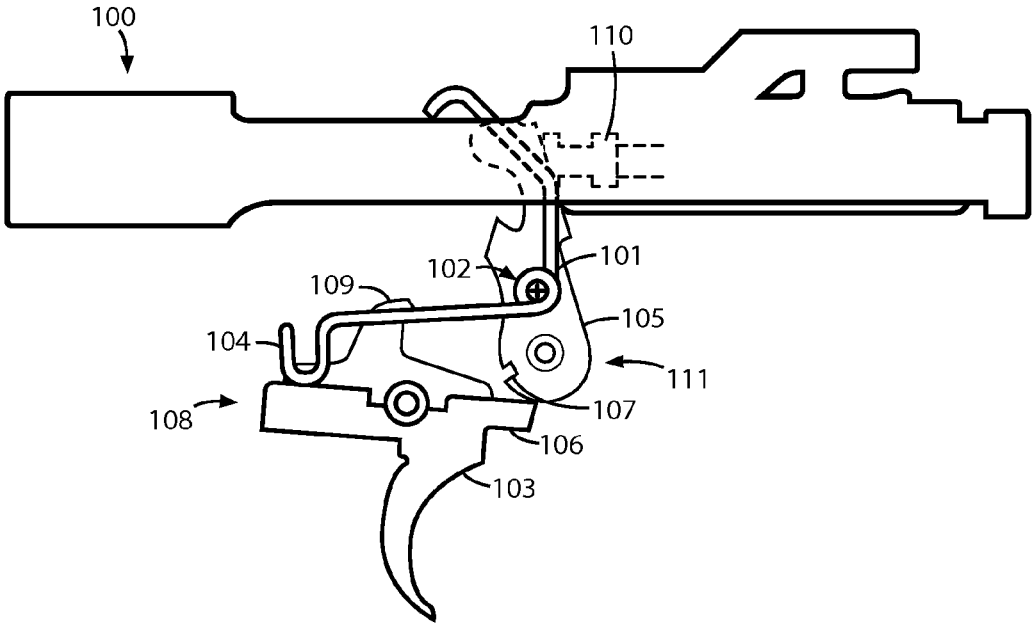
FIG. 1D shows one embodiment of a firearm having a trigger reset assist spring at a point in the firing cycle after discharge of a cartridge, wherein the bolt carrier group begins contact with the trigger reset assist spring.

The firing cycle continues with FIG. 1D, which shows one embodiment of a firearm having a trigger reset assist spring 102 at a point in the firing cycle after discharge of a cartridge, wherein the bolt carrier group 100 begins contact with the trigger reset assist spring 102. As the hammer 105 strikes the firing pin 110, an expansion of gasses results in discharge of the cartridge and generates a force that causes the bolt carrier group 100 to move rearwards. The rearward motion of the bolt carrier group 100 begins to force the hammer 105 back towards its closed bolt position (FIG. 1A). The trigger is still prevented from returning to its closed bolt position (FIG. 1A) by the contoured end 111 of the hammer 105.

Moreover, as the bolt carrier group 100 moves rearward, it begins to come into contact with the upper arm 101 of the trigger reset assist spring 102. This contact by the bolt carrier group 100 results in a force being applied to the upper arm 101 of the trigger reset assist spring 102, causing the upper arm 101 to begin its motion rearward. One having ordinary skill will appreciate that as the bolt carrier group 100 applies a force to the upper arm 101 of the trigger reset assist spring 102, a corresponding force, modulated only by the trigger reset assist spring configuration 102, is translated to the trigger 103 by the lower arm 104 of the trigger reset assist spring 102. One having ordinary skill in the art will appreciate that there is no defined endpoint to this stage in the firing cycle. Rather, the cycle continues seamlessly as the bolt carrier group 100 continues its rearward motion.

Figure 1E:
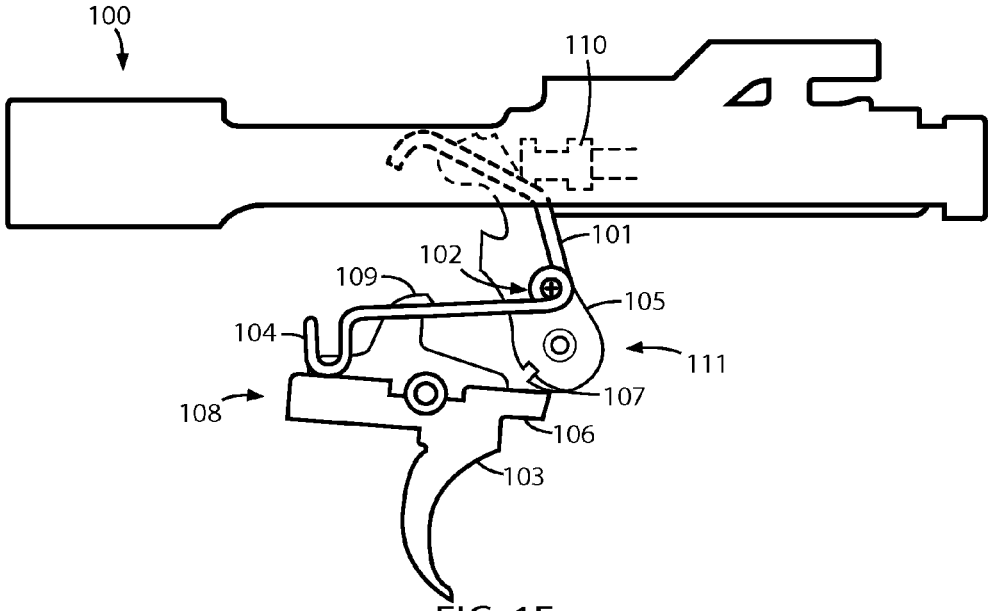
FIG. 1E shows one embodiment of a firearm having a trigger reset assist spring at a point in the firing cycle when the bolt carrier group continues its rearward motion following discharge of the cartridge.

With this in mind attention is directed to FIG. 1E, which shows one embodiment of a firearm having a trigger reset assist spring 102 at a point in the firing cycle when the bolt carrier group 100 continues its rearward motion following discharge of the cartridge. As the rearward motion of the bolt carrier group 100 continues, it applies even greater force to the upper arm 101 of the trigger reset assist spring 102. One having ordinary skill in the art will appreciate that a corresponding force, modulated only by the configuration of the trigger reset assist spring 102, is translated to the trigger 103 by the lower arm 104 of the trigger reset assist spring 102. Although the hammer 105 is moving closer to its closed bolt position (FIG. 1A), the contoured end 111 of the hammer 105 still prevents the trigger 103 from returning to its closed bolt position (FIG. 1A). One having ordinary skill in the art will appreciate that there is no defined endpoint to this stage in the firing cycle. Rather, the cycle continues seamlessly as the bolt carrier group 100 continues its rearward motion.

Figure 1F:
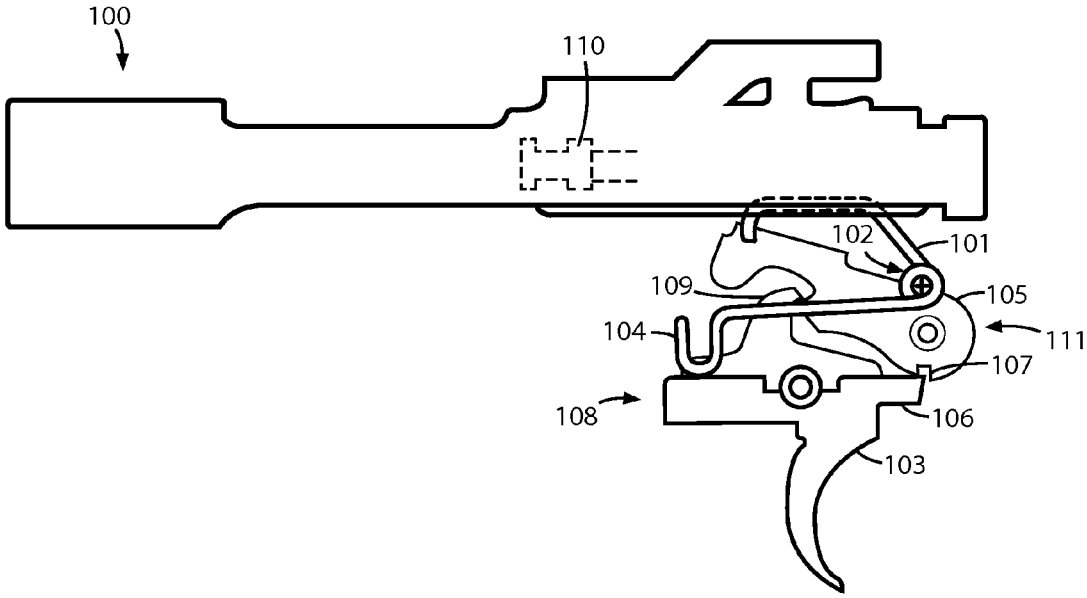
FIG. 1F shows one embodiment of a firearm having a trigger reset assist spring at a point in the firing cycle when the bolt carrier group stops its rearward motion and is about to reverse direction to chamber a new cartridge for a next firing cycle.

Discussion of the firing cycle continues with FIG. 1F, which shows one embodiment of a firearm having a trigger reset assist spring 102 at a point in the firing cycle when the bolt carrier group 100 stops its rearward motion and is about to reverse direction to chamber a new cartridge for a next firing cycle. The hammer 105, forced by the bolt carrier group 100, now engages the disconnector 109. Additionally, the hammer interlock 107 is allowed to engage the trigger sear 106 to lock the hammer 105 into its closed bolt or cocked position (FIG. 1A), if there is no interference from the user. As indicated above, a user with a finger extensor mobility limitation, such as that seen with rheumatoid arthritis or carpel tunnel syndrome, can prevent the trigger sear 106 from engaging the hammer interlock 107 at this point in the firing cycle simply by remaining in a contracted state and thus physically interfering with the motion of the trigger 103.

To overcome this interference with a user's finger, as the bolt carrier group 100 applies maximum force to the upper arm 101 of the trigger reset assist spring 102 a corresponding amount of force, modulated only by the configuration of the trigger reset assist spring 102, is translated to the trigger 103 by the lower arm 104 of the trigger reset assist spring 102. At this point, the force applied to the trigger 103 by the lower arm 104 of the trigger reset assist spring 102 is great enough to overcome the pressure provided by the user's contracted finger, thus allowing the trigger 103 to reset and the trigger group 108 to prepare for the next round. This action of the trigger assist spring 102 is also advantageous for use in competition settings where rapid firing is desired. One having ordinary skill in the art will appreciate that the trigger assist spring 102 increases the rate at which the trigger 103 engages the hammer 105. Thus, the disclosed trigger assist spring 102 has advantages for users with or without finger extensor mobility limitations.

It is important to understand that the amount of force applied by the trigger reset assist spring 102 to the trigger 103 is only great enough to overcome a force applied to the trigger 103 by a finger that is merely not extended and not actively engaging the trigger. In other words, the force applied by the trigger reset assist spring 102 is not great enough to overcome the force applied by a contracted finger actively engaging the trigger 103, such as the force applied to the trigger 103 to first activate it. Thus, it is possible for the user to actively engage the trigger 103, thereby preventing trigger reset, even when the trigger reset assist spring 102 is applying pressure to the trigger 103 as shown in FIG. 1F. Stated differently, a user can overcome the force applied by trigger reset assist spring 102 simply by continuously pulling the trigger 103 without ever releasing it. Even if the trigger 103 is not allowed to reset, it is important to understand that the firearm disclosed herein will still only fire one round. This is because the disconnector 109 has engaged the hammer 105, thus preventing it from engaging the firing pin 110 and initiating discharge of another round of ammunition.

Figure 1G:
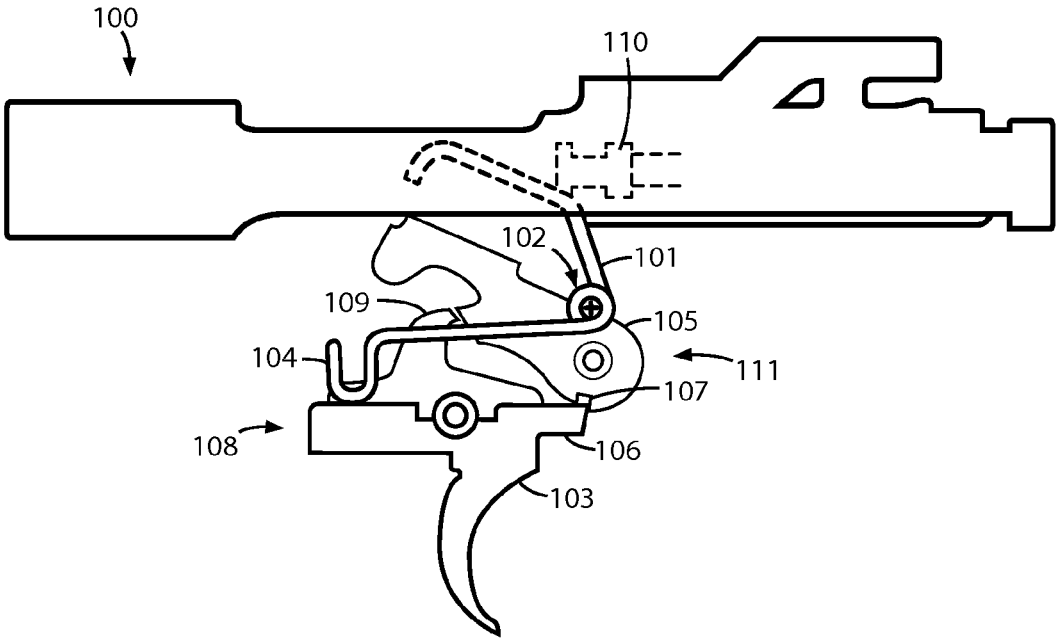
FIG. 1G shows one embodiment of a firearm of having a trigger reset assist spring at a point in the firing cycle wherein the bolt carrier group continues its forward motion to chamber the new cartridge for the next firing cycle.

Discussion of the firing cycle continues with FIG. 1G, which shows one embodiment of a firearm of having a trigger reset assist spring 102 at a point in the firing cycle wherein the bolt carrier group 100 continues its forward motion to chamber the new cartridge for the next firing cycle. At this point in the firing cycle, the bolt carrier group 100 is no longer in contact with the hammer 105, but is still in contact with the upper arm 101 of the trigger reset assist spring 102. Additionally, the hammer 105 is disengaged from the disconnector 109.

As the bolt carrier group 100 continues to move forward, the amount of force applied to the upper arm 101 of the trigger reset assist spring 102 decreases. One having ordinary skill will appreciate that likewise, the amount of force applied to the trigger 103 by the lower arm 104 of the trigger reset assist spring 102 is also decreased. However, it will be appreciated that the lower arm 104 of the trigger reset assist spring 102 is still applying force to the trigger 103 such that engagement of the trigger sear 106 and the hammer interlock 107 of the hammer 105 is maintained. One having ordinary skill in the art will appreciate that there is no defined endpoint to this stage in the firing cycle. Rather, the cycle continues seamlessly as the bolt carrier group 100 continues its forward motion towards its closed bolt position (FIG. 1A).

Figure 1H:
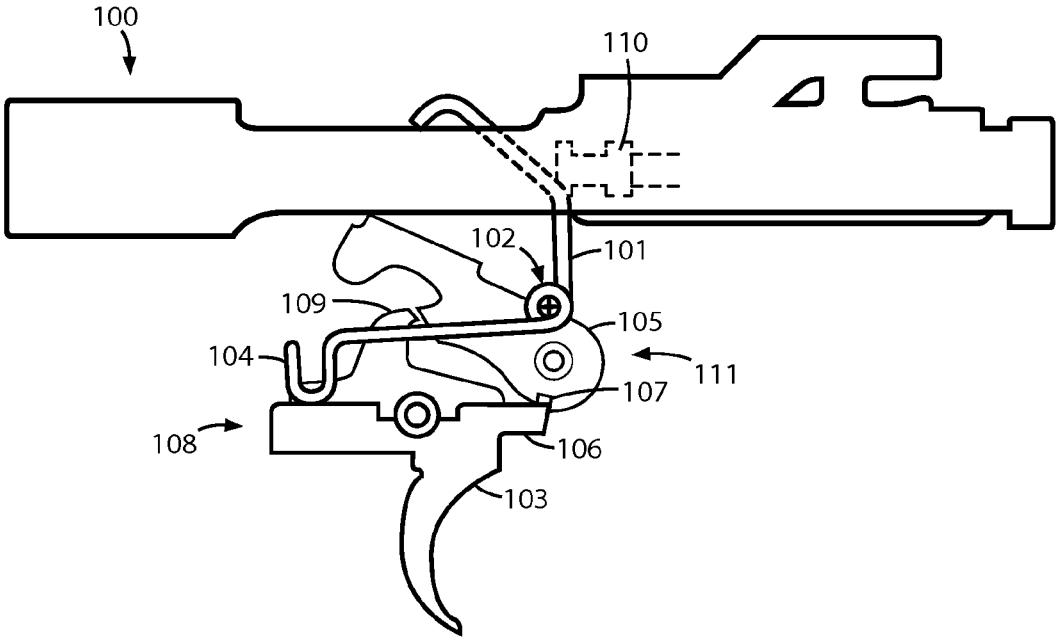
FIG. 1H shows one embodiment of a firearm of having a trigger reset assist spring at a point in the firing cycle immediately prior to the bolt carrier group chambering the new cartridge for the next firing cycle.

With that said, attention is directed to FIG. 1H, which shows one embodiment of a firearm of having a trigger reset assist spring 102 at a point in the firing cycle immediately prior to the bolt carrier group 100 chambering the new cartridge for the next firing cycle. At this point the bolt carrier group 100 is not in contact with the hammer 105, but continues to apply force to the upper arm 101 of the trigger reset assist spring 102. As the bolt carrier group 100 continues its forward motion, the amount of force applied to the upper arm 101 of the trigger reset assist spring 102 continues to correspondingly decrease. The lower arm 104 of the trigger reset assist spring 102 is still in contact with the trigger 103, and, as will be understood by one having ordinary skill in the art, continues to apply a force to the trigger 103 to maintain engagement of the trigger sear 106 and the hammer interlock 107. Insofar as the force being applied to the upper arm 101 of the trigger reset spring 102 is continually decreasing as the bolt carrier group 100 continues its forward motion, likewise, the force being applied to the trigger 103 by the lower arm 104 of the trigger reset spring 102 is also decreasing. One having ordinary skill in the art will appreciate that there is no defined endpoint to this stage in the firing cycle. Rather, the firing cycle continues seamlessly as the bolt carrier group 100 continues its forward motion towards its closed bolt position (FIG. 1A).

The firing cycle is ended when the bolt carrier group finishes its forward motion and returns to its closed bolt position as shown in FIG. 1A. At this point the trigger group 108 components have also returned to the closed bolt state and are as previously described in relation to FIG. 1A. The bolt carrier group 100 is no longer applying any force to the upper arm 101 of the trigger reset assist spring 102. Further, the lower arm 104 of the trigger reset assist spring 102 is no longer in contact with the trigger 103. As such, the lower arm 104 of the trigger reset assist spring 102 is no longer applying a force to the trigger 103. In short, the firearm has returned to the closed bolt position and is ready to begin a new firing cycle. The firing cycle, as described in FIGS. 1A through 1H, is completed each time the trigger is pulled or otherwise activated.

Figure 2A:
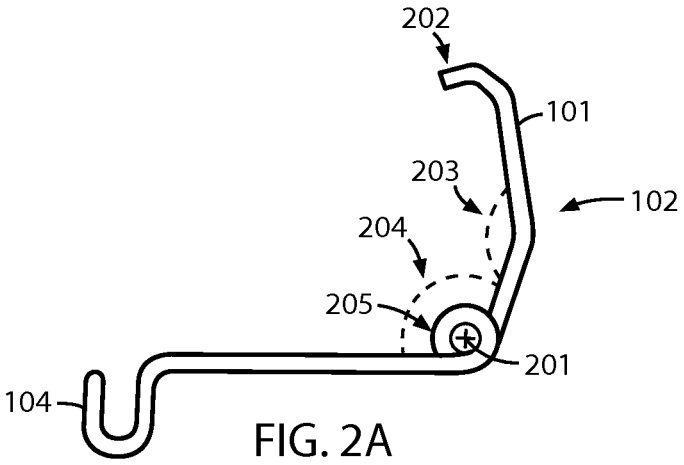
FIG. 2A shows a side view of one embodiment of the trigger reset assist spring in closed bolt position.
Figure 2B:
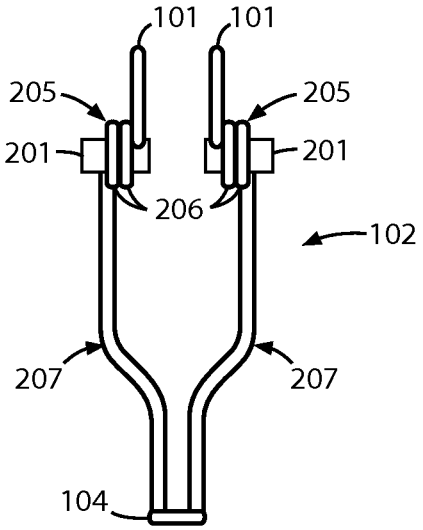
FIG. 2B shows a top view of one embodiment of the trigger reset assist spring of FIG. 2A.
Figure 2C:
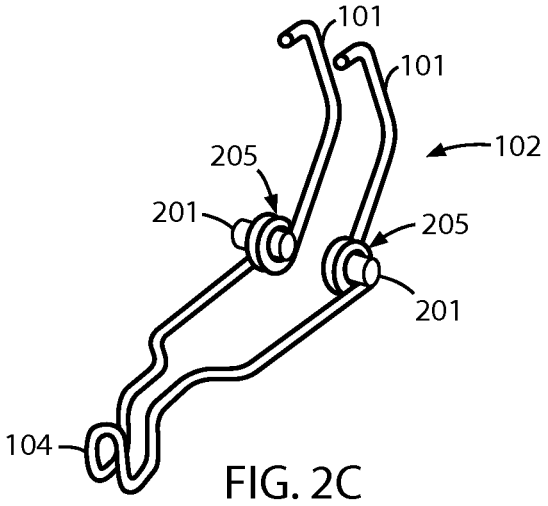
FIG. 2C shows a perspective view of the one embodiment of the trigger reset assist spring of 2A.

With the operation of a firearm employing the disclosed trigger reset assist spring 102 in mind, attention is directed to FIGS. 2A through 2C, which show one embodiment of the trigger reset assist spring 102 in greater detail. Insofar as different types of firearms have different dimensions associated with their corresponding parts, it will be appreciated that the exact size and dimensions of the trigger reset assist spring can be altered to fit with the dimensions of the firearm. However, there are certain aspects of the disclosed trigger reset spring that are important to maintaining function and compliance with government regulations. Thus, emphasis is placed not on the exact dimensions of the trigger reset spring 102, but rather on these important features.

With that said, attention is turned to FIG. 2A, which shows a side view of the trigger reset assist spring 102 in the closed bolt position (FIG. 1A). In other words, this is the position of the trigger reset assist spring 102 when no force is being applied to the upper arm 101 of the trigger reset spring 102. The upper arm 101 extends to from a coil body 205 to an upper-most end 202 of the trigger reset assist spring 102. It will be appreciated that in operation the coil body 205 surrounds a spring pivot pin 201. The spring pivot pin 201 functions to couple the trigger reset assist spring 102 to the firearm and are a point about which the trigger reset assist spring 102 will pivot. In some embodiments the spring pivot pin 201 is an existing hammer pivot pin, which is a part of the hammer 105 that couples the hammer to a receiver. In other embodiments, the spring pivot pin 201 is an existing hammer pin or an existing trigger pin. However, preferably, the spring pivot pin 201 is unique to the trigger reset spring 102, and, as will be discussed in detail in relation to FIGS. 3A and 3B, utilizes separate coupling holes located above, and in addition to, existing hammer pin and trigger pin holes. The lower arm 104 of the trigger reset spring 102 extends from the spring pivot pin 201 to the "U" shaped curve located at the opposite end of the trigger reset spring 102 from the upper arm 101.

Important to the function of the trigger reset assist spring 102 and its ability to operate as intended within a firearm is the angle 203 at which the upper arm 101 is bent and the angle 204 at which upper arm 101 and the lower arm 104 are articulated around the spring pivot pin 201. As stated above, the exact degrees for the angles 203 and 204 will depend upon the exact dimensions of the firearm. Importantly, the exact angles should allow for the bolt carrier group 100 to apply a force to the upper arm 101 and result in a force being applied to the trigger 103 by the lower arm 104 at an appropriate time in the firing cycle as described in relation to FIGS. 1A through 1H. Further, the exact angles should result in a force only great enough to overcome a force applied by a merely unextended finger. Preferably, the amount of force applied to the trigger 103 by the lower arm 104 is between approximately two (2) and approximately five (5) pounds of force.

Moreover, the degree of the angle at which the upper arm 101 is bent can affect the speed at which the trigger is reset. One having ordinary skill in the art will appreciate that if the angle 203 at which the upper arm 101 is bent and/or the angle 204 at which the upper arm 101 and the lower arm 104 is articulated around the spring pivot pin 201 is decreased, it will take a longer amount of time for the bolt carrier group to interact with the upper arm 101 as the upper arm 101 will be in a more rearward position, which decreases how fast trigger reset can occur.

Alternatively, if the angle 203 at which the upper arm 101 is bent and/or the angle 204 at which the upper arm 101 and the lower arm 104 are articulated around the spring pivot pin 201 is too great, the trigger assist spring 102 will be in contact with the bolt carrier group 102 too soon in the firing cycle and, thus apply pressure to the trigger 103 too soon in the firing cycle and not allow the trigger sear 106 to disengage the hammer interlock 107. In sum, although the exact angles of the trigger reset assist spring 102 may vary from firearm to firearm, they still should allow for faster trigger reset, over what can be achieved by a firearm's stock trigger reset spring, while not impeding the normal firing cycle.

For example, for an assault rifle platform, the angle 203 at which the upper arm 101 is bent can be anywhere from approximately 90 degrees to approximately 180 degrees, but is preferably approximately 126.5 degrees. The angle 204 at which the upper arm 101 and the lower arm 104 are articulated around the spring pivot pin 201 can be anywhere from approximately 90 degrees to approximately 150 degrees, but is preferably approximately 126 degrees. It will be appreciated that the angle 203 at which the upper arm 101 is bent and the angle 204 at which the upper arm 101 and the lower arm 104 are articulated around the spring pivot pin 201 are optimized based on the location of the spring pivot pin 201 in relation to a hammer pin and other components of the firearm.

Discussion of the disclosed trigger reset assist spring 102 continues with FIG. 2B, which shows a top view of one embodiment of the trigger reset assist spring 102. In this view, it is apparent that there are two sides of the trigger reset assist spring 102 that are mirror images of one another. In a preferred embodiment, the upper arms 101 are not connected to one another. This is to reduce interference of the trigger reset assist spring 102 with any other components of the firearm during operation, particularly the hammer 105 and disconnector 109. As different firearms have different configurations of components of the trigger group 108, in some embodiments, the upper arms 101 are connected to one another and, yet, do not interfere with any other components of the fire arm during operation.

At the heart of the disclosed trigger reset assist spring 102 is a coil body 205. In the preferred embodiment the trigger reset assist spring comprises two coil bodies 205, one on each side bridged together by the lower arm 104. The number of coils 206 within a coil body 205 is dependent upon many factors, such as wire diameter of trigger reset assist spring 102, the angle (FIG. 2A, 203) at which the upper arm 101 is bent, the angle (FIG. 2A, 204) at which the upper arm 101 and the lower arm 104 are articulated around the spring pivot pin 201, and amount of force desired to be translated to the trigger 103 from the bolt carrier group 100 by the trigger reset assist spring 102. Although the number of coils can vary, there should be at least one in order for the spring to operate as a torsion spring and result in translation of a force from the bolt carrier group 100 to the trigger 103.

The configuration of the lower arm 104 is also important to the performance of the disclosed trigger reset assist spring 102. The lower arm 104 is curved at points 207 along its length so as to allow for clearance of the various components of the trigger group 108 and firearm. The exact distance between the two sides of the lower arm 104 is dependent upon the exact dimensions of the firearm. However, regardless of the exact dimensions of the firearm, the lower arm will be curved 207 in a region, to allow for the trigger reset assist spring 102 to operate as described in FIGS. 1A through 1H without interfering with any components of the firearm, except for those components with which the disclosed trigger reset assist spring 102 is designed to come into contact. More significantly, the configuration of the lower arm 104 allows the disclosed trigger reset assist spring 102 to avoid any contact with the disconnector 109. It is against government regulation to add any component to a firearm that would come in contact with or otherwise interfere with the disconnector 109.

To fully appreciate the configuration of the disclosed trigger reset assist spring 102, attention is turned to FIG. 2C, which shows a perspective view of the preferred embodiment of the trigger reset assist spring 102. It is important to note that the "U" shape of the end of the lower arm 104 allows the trigger reset assist spring 102 to come in contact with the trigger 103 and apply force to the trigger 103, while completely avoiding contact with other components of the trigger group 108 and the firearm, particularly the disconnector 109.

Figure 3A:
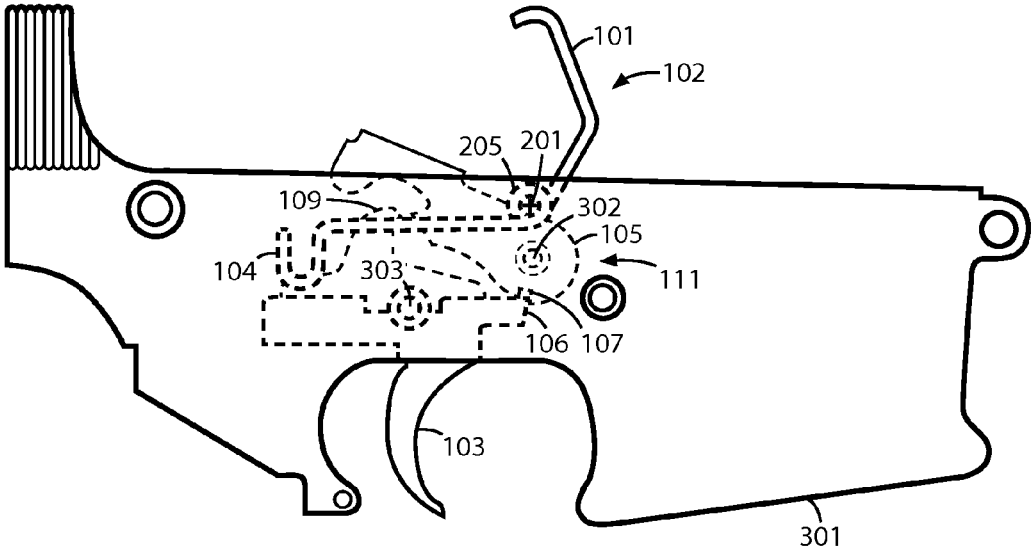
FIG. 3A shows a side view of one embodiment of a trigger reset assist spring coupled to a receiver utilizing coupling holes located above and in addition to an existing hammer pivot pin, or existing hammer pin holes, or existing trigger pin holes.
Figure 3B:
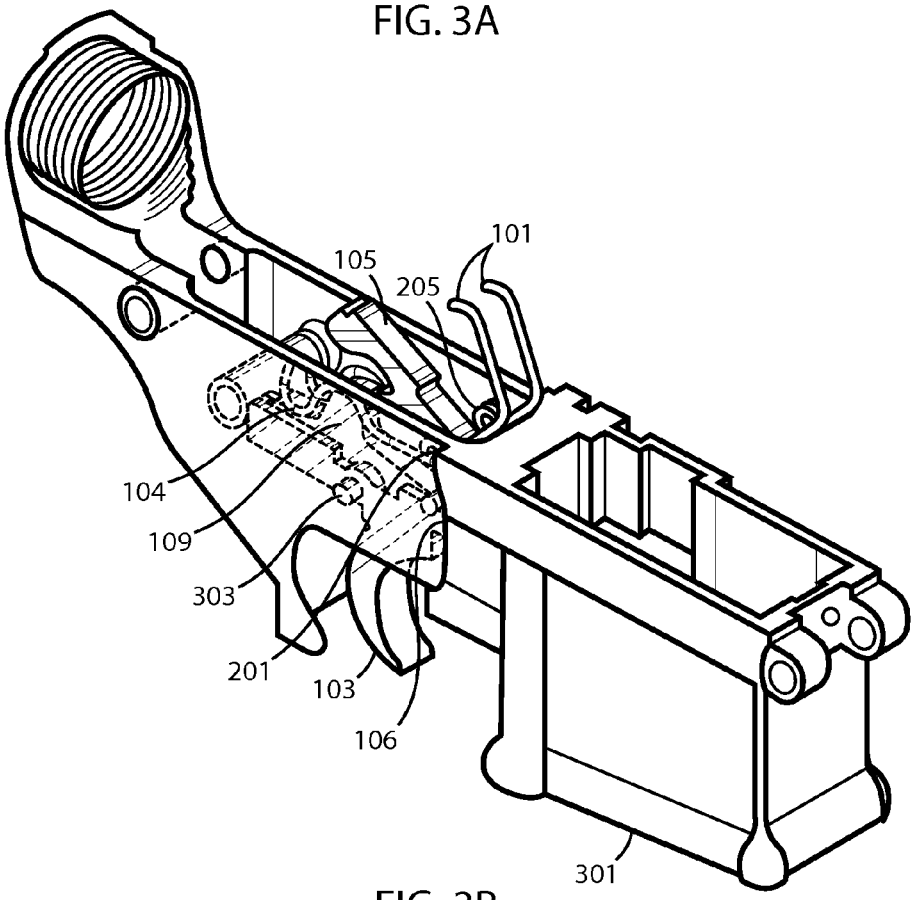
FIG. 3B shows an alternate view of the trigger reset assist spring and receiver shown in FIG. 3A.

With the various aspects of the trigger reset assist spring 102 in mind, attention is directed to FIGS. 3A and 3B which show several views of a firearm employing the disclosed trigger reset assist spring 102, wherein the spring pivot pins 201 utilize spring pivot pin holes, which are in addition to any existing hammer pin, hammer pivot, or trigger pin holes.

Discussion of this preferred embodiment begins with FIG. 3A, which shows a side view of one embodiment of the trigger reset assist spring 102 coupled to a receiver, utilizing coupling holes located above and in addition to an existing hammer pivot pin, or existing hammer pin holes, or existing trigger pin holes. In this preferred embodiment, the trigger reset assist spring 102 is coupled to a receiver 301 of a firearm by inserting the spring pivot pins 201 through two holes placed in the receiver 301 that are in addition to the existing hammer pin holes 302 or trigger pin holes 303 in the receiver 301. The receiver 301 is a part of the firearm that houses operating parts. Typically, the receiver 301 houses the bolt carrier group 100, trigger group 108 and, if present, a magazine port. Generally, applicable laws view the receiver 301 as that part of a firearm housing that has a serial number upon it.

Preferably, the spring pivot pin holes are placed above the existing hammer pin holes 302 or trigger pin holes 303. The exact position of the spring pivot pin holes above the existing hammer pin 302 and trigger pin 303 holes is determined upon the exact dimension of the firearm and the trigger reset assist spring 102. The spring pivot pins 201 after being placed in the spring pivot pin holes are secured to the receiver 301 using mechanical fasteners, which are threaded or unthreaded. In some embodiments, the spring pivot pins 201 are also the mechanical fasteners, and thus attach directly to the receiver 301. It will be appreciated that in embodiments where the spring pivot pins 201 are also the mechanical fasteners, the spring pivot pins 201 will still operate to allow the trigger reset assist spring 102 to pivot about the spring pivot pins 201.

In some embodiments the mechanical fasteners are service removable. It will be appreciated by one having ordinary skill in the art that, for those embodiments in which the mechanical fasteners are service removable, it is not possible to link a particular trigger reset assist spring 102 to a receiver's serial number. Thus, for embodiments where it is required to link a receiver's serial number and the trigger reset assist spring 102, the mechanical fasteners are of a swaged design to prevent removal of the trigger reset assist spring 102 from the receiver 301. One having ordinary skill in the art will appreciate that fasteners of a swaged design will thus link the trigger spring apparatus 102 to the receiver's serial number.

To more fully appreciate the preferred embodiment of the disclosed trigger reset assist spring 102 coupled to a receiver 301, attention is directed to FIG. 3B, which shows an alternative view of one embodiment of the trigger reset assist spring 102 and receiver 301 shown in FIG. 3A.

In another embodiment of a firearm having a trigger reset assist spring 102, the trigger reset assist spring 102 is coupled to a firearm through use of existing hammer pins and trigger pins. In these embodiments, the trigger reset assist spring 102 is first attached to two (2) thin mounting plates. The thin mounting plates are anywhere from approximately 0.030 inches to 0.090 inches thick. Preferably, the thin mounting plates are 0.060 inches to 0.075 inches thick. In some embodiments the thin mounting plates are uniform in thickness. In other embodiments, the thin mounting plates vary in thickness over their entirety.

In some embodiments, the trigger reset assist spring is attached to the mounting plates by mechanically fastening the spring pivot pins to the mounting plates utilizing holes existing in the mounting plates. In some embodiments, the spring pivot pins are threaded. In other embodiments, the spring pivot pins are unthreaded. In the embodiments that employ unthreaded spring pivot pins, a clinching or a swage fastener design is used to attach the spring pivot pins to the mounting plates. The mounting plates are coupled to the receiver 301 by utilizing the existing hammer pins and hammer pin holes and/or the existing trigger pin and trigger pin holes of the firearm. As the mounting plates are permanently affixed to the receiver 301, this embodiment is linked to the receiver's serial number. Alternatively, in some embodiments the mounting plates are independently serialized to allow for traceability.

Figure 4A:
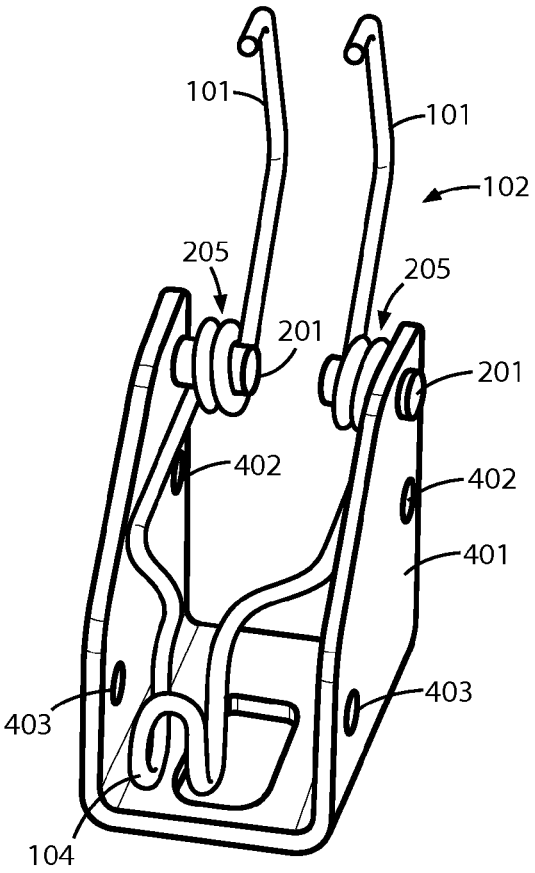
FIG. 4A shows one embodiment of a trigger reset assist spring integrated with a modular drop-in assembly.

In some instances, a modular drop-in assembly is preferred. With this in mind attention is directed to FIGS. 4A and 4B, which show a trigger reset assist spring 102 integrated with a modular drop-in assembly that also comprises other trigger group 108 components. FIG. 4A shows one embodiment of a trigger reset assist spring 102 integrated with a modular drop-in assembly. For clarity, the other trigger group 108 components are omitted from FIG. 4A, emphasis instead being placed on coupling of the trigger reset assist spring 102 to an assembly housing 401. As shown, the trigger reset assist spring 102 is coupled to the assembly housing 401 by inserting the spring pivot pins 201 into spring pivot holes in the assembly housing 401. Preferably, the spring pivot holes are in addition to and located higher on the assembly housing 401 than a set of hammer pin holes 402 and trigger pin holes 403. In the preferred embodiment, the spring pivot pins 201 are coupled to the assembly housing 401 by mechanical fasteners. In other embodiments, the spring pivot pins 201 are also the mechanical fasteners.

Figure 4B:
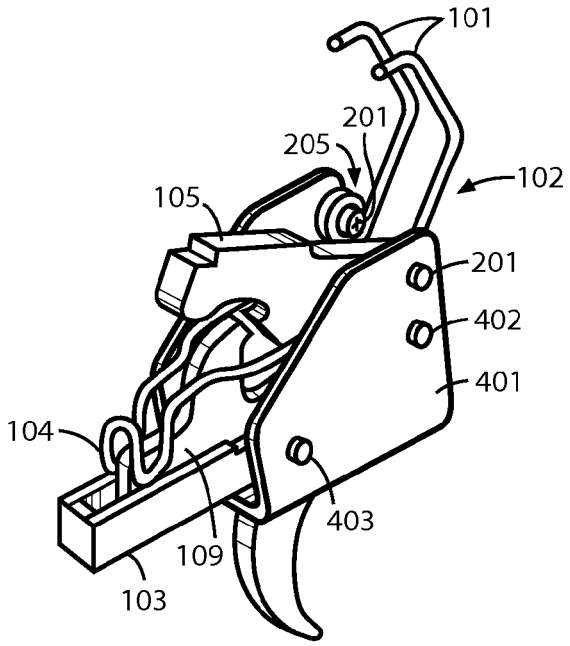
FIG. 4B shows one embodiment of an entire drop-in assembly having the disclosed trigger reset assist spring and assembly housing of FIG. 4A

With coupling of the disclosed trigger reset assist spring 102 to the assembly housing 401 in mind, attention is directed to FIG. 4B, which shows one embodiment of an entire drop-in assembly having the disclosed trigger reset assist spring and assembly housing of FIG. 4A. In a preferred embodiment, the drop-in assembly comprises all the components of the trigger group 108, including the trigger 103, hammer 105 and disconnector 109, as well as the disclosed trigger reset assist spring 102. The hammer 105 and trigger 103 are coupled to the assembly housing 401 by placing the hammer pin through the hammer pin hole 402 on the assembly housing 401, and by placing the trigger pin through the trigger pin hole 403. The hammer and trigger pins are secured to the assembly housing 401 by mechanical fasteners. In some embodiments the assembly housing 401 is serialized to allow for traceability. It will be appreciated that the hammer pins and trigger pins are typically tubular and are thus hollow through their centers. However, in some instances they may be solid.

In yet another embodiment, the trigger reset assist spring 102 is coupled to the firearm by placing the coil bodies 205 around the hammer pivot pin. This is in contrast to the embodiments disclosed in FIGS. 3A and 3B, wherein the coil bodies 205 of the trigger reset assist spring 102 are coiled around spring pivot pins 201, which are independent of the hammer pivot pin. For some firearms, attachment of the trigger reset assist spring 102 to the firearm by coupling it to the hammer pivot pin is the least efficient design because it can result in the trigger assist spring 102 having a less than optimal shape. For example, one having ordinary skill in the art will appreciate that by placing the coil bodies 205 at the hammer pivot pin, the upper arm 101 of the trigger reset assist spring 102 must have a decreased angle 203 of bend, which reduces the efficiency of the trigger reset assist spring 102. Further, this embodiment does not allow for traceability insofar as the trigger reset assist spring 102 is not permanently linked to the receiver's serial number.

The embodiments disclosed herein allow for increased and consistent semi-automatic firing rates approaching those of currently legal "bump-fire-stock" firearms without having inaccuracies due to movement of the receiver of the firearm. Importantly, the disclosed embodiments have the advantage of being able to be operated with a single hand. This is in stark contrast to "bump-fire-stock" firearms, which require the use of two hands to properly operate. Thus, the disclosed embodiments allow effective operation of a firearm by a user who only has use of one hand, such as in a prone, seated kneeling or standing position with use of a biopod or a monopod firearm support device. This functionality is not possible with a conventional "bump-fire-stock" firearm. Moreover, the disclosed embodiments are of ergonomic value to firearm enthusiasts that have limitations to extensor ability of their trigger finger. In sum, the disclosed embodiments provide beneficial improvement for firearm users with and without finger extensor ability limitations.

Although exemplary embodiments have been shown and described, it will be apparent to those of ordinary skill in the art that a number of changes, modifications, or alterations to the disclosure as described may be made. The method of operation is described in relation to a closed bolt firing cycle, however modifications of the disclosed trigger reset assist spring to allow for operation during operation of an open bolt firing cycle will be appreciated by one having ordinary skill in the art and are within the scope of this disclosure.

Further, the embodiments disclosed herein will be appreciated by one having skill in the art to be applicable to a variety of firearms including, but not limited to, pistols that are of a semi-automatic or of a single action design, shotguns that are of a semi-automatic or pump design, and rifles of a semi-automatic or pump design.

Additionally, the embodiments disclosed herein will be appreciated by one having skill in the art to be applicable to firearms employing a direct impingement operation as well as a blowback operation method. In a direct impingement operation gas is directed from a fired cartridge directly to the bolt carrier group or a slide assembly to further cycle action. A blowback system of operation is typical for self-loading firearms, and obtains energy from a motion of the cartridge as the cartridge is pushed to the rear part of the bolt carrier group by gasses created by ignition of the gas or propellant charge.

The apparatus and method disclosed herein is to be appreciated as being fully compatible with centerfire and rimfire cartridges. Further, it will be appreciated that a typical caliber compatibility range for the apparatus and method disclosed herein ranges from approximately 17 caliber to 50 caliber cartridges.

Moreover, one having ordinary skill in the art will appreciate that the disclosed embodiments are compatible with firearms employing a striker method of operation as well as a hammer method of operation.

All such changes, modifications, and alterations should therefore be seen as within the scope of the disclosure.

What is claimed is:

1. In a firearm having a trigger, a trigger pin, a hammer pin, and a bolt carrier group, a trigger reset assist apparatus comprising:

a spring pivot pin; and a trigger reset assist spring applying no force to the trigger at a start of a firing cycle, the trigger reset assist spring being a torsion spring secured to the spring pivot pin, the torsion spring comprising upper arms and lower arms, the lower arms being mechanically bridged together.

2. The apparatus of claim 1, the trigger reset assist spring to translate an applied force of between approximately 2 pounds to approximately 5 pounds from the bolt carrier group to the trigger after release of a trigger sear from a hammer interlock.

3. The apparatus of claim 1, the trigger reset assist spring to apply a substantially identical to the force to the bolt carrier group and the trigger after release of a trigger sear from a hammer interlock.

4. The apparatus of claim 1, the translated force being substantially different from the force applied by the bolt carrier group.

5. The apparatus of claim 1, the lower arms for contacting the trigger to apply a force to the trigger after release of a trigger sear from a hammer interlock.

6. The apparatus of claim 1, the upper arms having a first bend with an angle in a range of approximately 90 degrees and approximately 180 degrees.

7. The apparatus of claim 6, the upper having a second bend with an angle in a range of approximately 90 degrees and approximately 150 degrees.

8. The apparatus of claim 1, the lower arms of the trigger reset assist spring to apply a force to the trigger only after release of a trigger sear from a hammer interlock.

9. In a firearm comprising a trigger, a trigger pin, and a hammer pin, a system to assist in resetting the trigger, the system comprising:

a firearm receiver;

a bolt carrier group for applying a force, the bolt carrier group mechanically coupled to the firearm receiver;

a spring pivot pin; and a trigger reset assist spring applying no force to the trigger at a start of a firing cycle, the trigger reset assist spring being mounted to the spring pivot pin, the trigger reset assist spring being a double torsion spring comprising upper arms and lower arms, the lower arms being mechanically bridged together.

10. The system of claim 9, further comprising a housing assembly mechanically fastened to the firearm receiver.

11. The system of claim 9, the trigger reset assist spring to apply a force of between approximately 2 pounds to approximately 5 pounds to the trigger after release of a trigger sear from a hammer interlock.

12. The apparatus of claim 9, the lower arms of the trigger reset assist spring to apply a force to the trigger only after release of a trigger sear from a hammer interlock.

13. A system comprising:

a spring pivot pin;

trigger reset assist means for assisting a reset of a trigger, the trigger reset assist means being pivotally coupled to the spring pivot pin;

means for applying a first force to a trigger after a release of a trigger sear from a hammer interlock; and means for applying a second force to a bolt carrier group after the release of the trigger sear from the hammer interlock.

14. The system of claim 13, the first force and the second force being applied substantially simultaneously.

* * * * *